US010685774B2

(12) United States Patent
Yoshida et al.

(10) Patent No.: US 10,685,774 B2
(45) Date of Patent: Jun. 16, 2020

(54) REACTOR HAVING IRON CORES AND COILS

(71) Applicant: FANUC CORPORATION, Yamanashi (JP)

(72) Inventors: Tomokazu Yoshida, Yamanashi (JP); Masatomo Shirouzu, Yamanashi (JP); Kenichi Tsukada, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 45 days.

(21) Appl. No.: 16/039,332

(22) Filed: Jul. 19, 2018

(65) Prior Publication Data

US 2019/0035531 A1 Jan. 31, 2019

(30) Foreign Application Priority Data

Jul. 26, 2017 (JP) ..... 2017-144705

(51) Int. Cl.

| | |
|---|---|
| ***H01F 30/12*** | (2006.01) |
| ***H01F 27/28*** | (2006.01) |
| ***H01F 27/02*** | (2006.01) |
| ***H01F 27/24*** | (2006.01) |
| ***H01F 3/14*** | (2006.01) |
| ***H01F 37/00*** | (2006.01) |
| ***H01F 27/29*** | (2006.01) |

(52) U.S. Cl.

CPC ..... *H01F 27/28* (2013.01); *H01F 3/14* (2013.01); *H01F 27/02* (2013.01); *H01F 27/24* (2013.01); *H01F 27/29* (2013.01); *H01F 37/00* (2013.01); *H01F 27/2852* (2013.01)

(58) Field of Classification Search

CPC ..... H01F 30/12; H01F 3/12
USPC ..... 336/5
See application file for complete search history.

(56) References Cited

U.S. PATENT DOCUMENTS

| | | | | |
|---|---|---|---|---|
| 4,975,670 | A * | 12/1990 | Krinickas, Jr. | H01F 27/303 336/197 |
| 9,613,745 | B2 * | 4/2017 | Shudarek | H01F 37/00 |
| 10,008,322 | B2 * | 6/2018 | Bhide | H01F 37/00 |
| 2009/0261939 | A1 * | 10/2009 | Shudarek | H01F 3/10 336/212 |
| 2012/0106210 | A1 * | 5/2012 | Xu | H02P 9/02 363/37 |
| 2013/0187741 | A1 * | 7/2013 | Goodrich | H01F 3/10 336/170 |

(Continued)

FOREIGN PATENT DOCUMENTS

| | | | |
|---|---|---|---|
| CN | 201765902 | U | 3/2011 |
| CN | 106463249 | A | 2/2017 |

(Continued)

*Primary Examiner* — Ronald Hinson
(74) *Attorney, Agent, or Firm* — Hauptman Ham, LLP

(57) ABSTRACT

A core body of a reactor include an outer peripheral iron core, at least three iron cores arranged in contact with or coupled to an inner surface of the outer peripheral iron core, and at least three coils wound onto the at least three iron cores. Gaps, which can be magnetically coupled, are formed between the at least three iron cores. The reactor further includes a protection part which at least partially protects projection portions of the at least three coils which project from at least one end surface of the core body.

8 Claims, 9 Drawing Sheets

(56) References Cited

U.S. PATENT DOCUMENTS

| | | | | |
|---|---|---|---|---|
| 2016/0125998 | A1* | 5/2016 | Bhide | H01F 37/00 336/5 |
| 2017/0040099 | A1* | 2/2017 | Bhide | H01F 27/245 |
| 2017/0154718 | A1 | 6/2017 | Maeda et al. | |

FOREIGN PATENT DOCUMENTS

| | | | |
|---|---|---|---|
| CN | 106816279 | A | 6/2017 |
| JP | S49-43123 | A | 4/1974 |
| JP | S54-136656 | A | 10/1979 |
| JP | 2000-77242 | A | 3/2000 |
| JP | 2008-210998 | A | 9/2008 |
| JP | 2010-129782 | A | 6/2010 |
| JP | 2010-165884 | A | 7/2010 |
| JP | 2011254005 | A | 12/2011 |
| JP | 2015-32814 | A | 2/2015 |
| JP | 2016-122830 | A | 7/2016 |
| JP | 2017-59805 | A | 3/2017 |
| JP | 2017-69525 | A | 4/2017 |
| JP | 2017-103269 | A | 6/2017 |

* cited by examiner

REACTOR HAVING IRON CORES AND COILS

RELATED APPLICATIONS

The present application claims priority of Japanese Application Number 2017-144705, filed on Jul. 26, 2017, the disclosure of which is hereby incorporated by reference herein in its entirety.

BACKGROUND OF THE INVENTION

1. Field of the Invention

The present invention relates to a reactor having iron cores and coils.

2. Description of Related Art

Reactors include a plurality of iron core coils, and each iron core coil includes an iron core and a coil wound onto the iron core. Predetermined gaps are formed between the plurality of iron cores. Refer to, for example, Japanese Unexamined Patent Publication (Kokai) No. 2000-77242 and Japanese Unexamined Patent Publication (Kokai) No. 2008-210998.

There are also reactors in which a plurality of iron core coils are arranged inside an annular outer peripheral iron core. In such reactors, the outer peripheral iron core can be divided into a plurality of outer peripheral iron core portions, and the iron cores may be formed integrally with the respective outer peripheral iron core portions.

SUMMARY OF INVENTION

In such reactors, the coils portions which project from an end surface of the core body in the axial direction of the core body. When the core body is arranged between an annular pedestal and an end plate, there is a problem in that the projection portions of the coils passing through the pedestal and/or the end plate may become damaged due to interference with foreign matter or the like.

Thus, a reactor in which damage to the coils can be prevented is desired.

According to a first aspect of the present disclosure, there is provided a reactor comprising a core body, the core body comprising an outer peripheral iron core, at least three iron cores arranged in contact with or coupled to an inner surface of the outer peripheral iron core, and at least three coils wound onto the at least three iron cores, wherein gaps, which can be magnetically coupled, are formed between one of the at least three iron cores and another iron core adjacent thereto, the reactor further comprising a protection part which at least partially protects projection portions of the at least three coils which project from at least one end surface of the core body.

In the first aspect, since the projection portions of the coils are protected by the protection part, damage to the coils can be prevented.

The object, features, and advantages of the present invention, as well as other objects, features and advantages, will be further clarified by the detailed description of the representative embodiments of the present invention shown in the accompanying drawings.

DETAILED DESCRIPTION

Figure 1A:
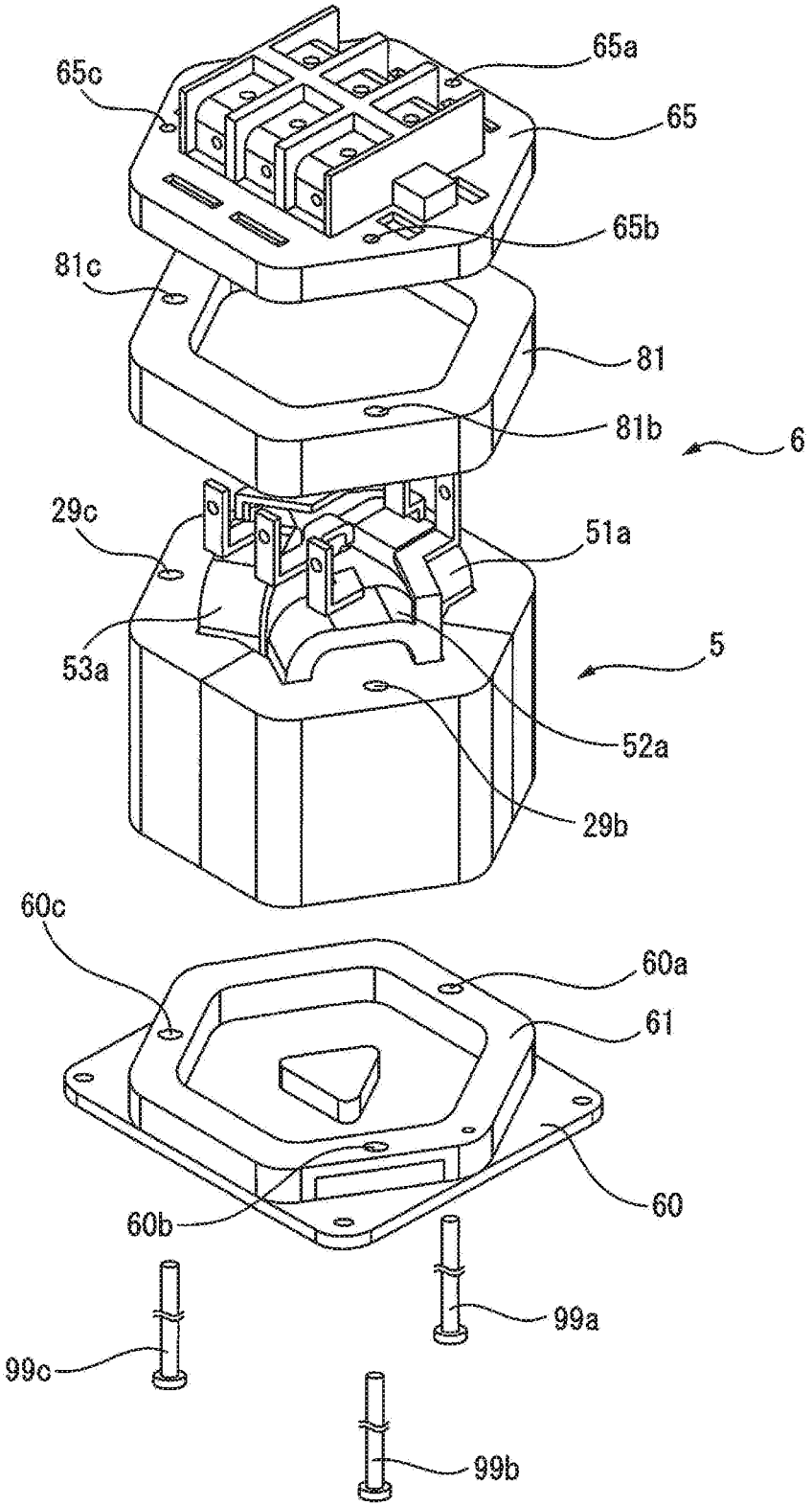
FIG. 1A is an exploded perspective view of a reactor according to a first embodiment.

The embodiments of the present invention will be described below with reference to the accompanying drawings. In the following drawings, the same components are given the same reference numerals. For ease of understanding, the scales of the drawings have been appropriately modified.

In the following description, a three-phase reactor will be mainly described as an example. However, the present disclosure is not limited in application to a three-phase reactor but can be broadly applied to any multiphase reactor requiring constant inductance in each phase. Further, the reactor according to the present disclosure is not limited to those provided on the primary side or secondary side of the inverters of industrial robots or machine tools but can be applied to various machines.

Figure 1B:
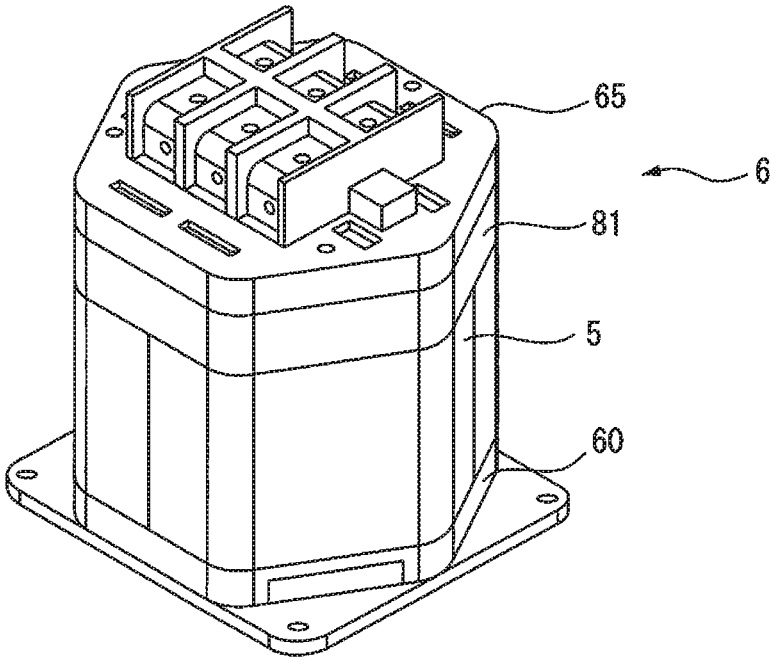
FIG. 1B is a perspective view of the reactor shown in FIG. 1A.

FIG. 1A is an exploded perspective view of a reactor according to a first embodiment and FIG. 1B is a perspective view of the reactor shown in FIG. 1A. As shown in FIG. 1A and FIG. 1B, a reactor 6 mainly includes a core body 5, a pedestal 60 attached to one end of the core body 5, an annular end plate 81 attached to the other end of the core body 5, and a terminal block 65 attached to the end plate 81. In other words, the axial ends of the core body 5 are interposed by the pedestal 60 and the end plate 81 and the terminal block 65. Note that the terminal block 65 may have, on the lower surface thereof, a protruding part (not shown) having a shape similar to that of the end plate 81. In such a case, the end plate 81 may be omitted.

An annular projecting part 61 having an outer shape corresponding to that of the end surface of the core body 5 is provided on the pedestal 60. Through-holes 60*a* to 60*c* which penetrate the pedestal 60 are formed in the projecting part 61 at equal intervals in the circumferential direction. The end plate 81 has a similar outer shape, and through-holes 81*a* to 81*c* are formed in the end plate 81 at equal intervals in the circumferential direction. The heights of the projection part 61 of the pedestal 60 and the end plate 81 are made longer than the projecting height of the coils 51 to 53 projecting from the end of the core body 5, as will be described later.

The terminal block 65 includes a plurality of, for example, six terminals. The plurality of terminals are connected to a plurality of leads extending from the coils 51 to 53. Through-holes 65*a* to 65*c* are formed in the terminal block 65 at equal intervals in the circumferential direction.

Figure 2:
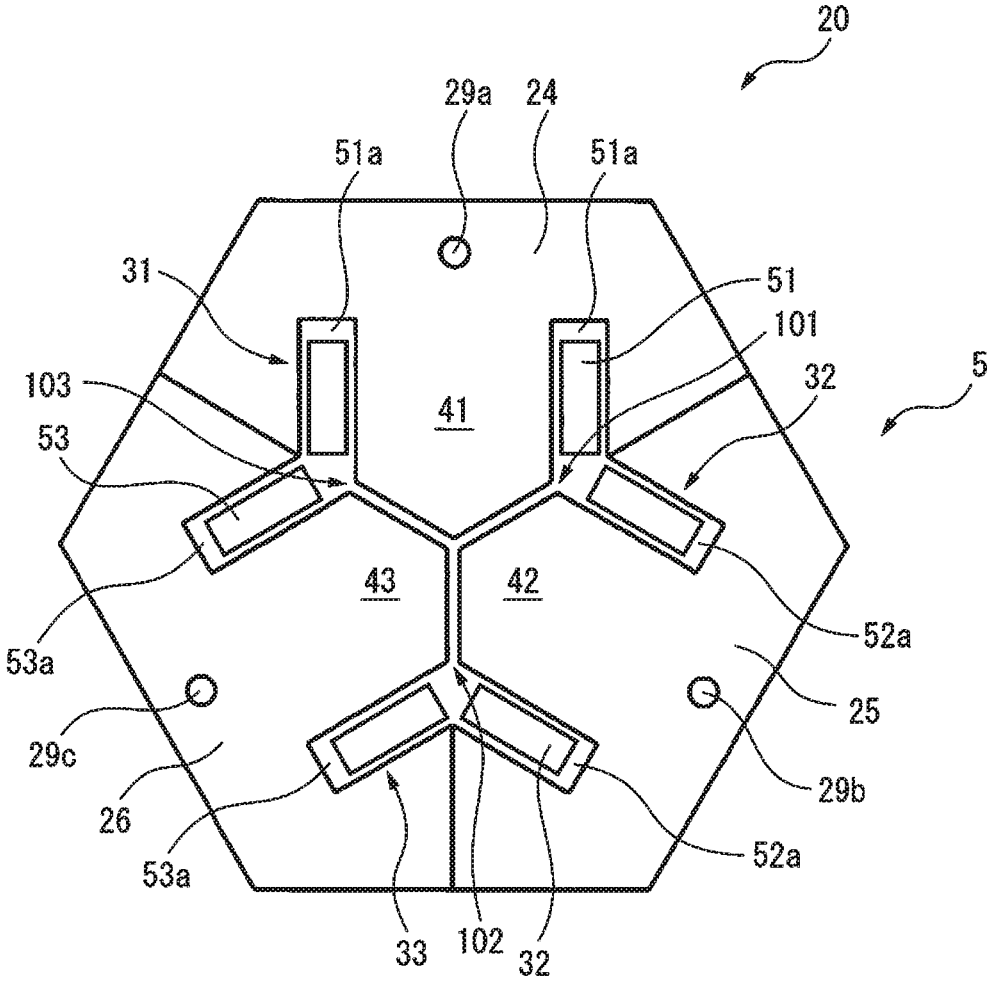
FIG. 2 is a cross-sectional view of the core body of the reactor according to the first embodiment.

FIG. 2 is a cross-sectional view of the core body of the reactor according to the first embodiment. As shown in FIG.

2, the core body 5 of the reactor 6 includes an annular outer peripheral iron core 20 and three iron core coils 31 to 33 arranged inside the outer peripheral iron core 20. In FIG. 2, the iron core coils 31 to 33 are arranged inside the substantially hexagonal outer peripheral iron core 20. The iron core coils 31 to 33 are arranged at equal intervals in the circumferential direction of the core body 5.

Note that the outer peripheral iron core 20 may have other rotationally-symmetrical shapes, such as a circular shape. In such a case, the outer peripheral iron core 20 has a shape corresponding to the terminal block 65, the end plate 81, and the pedestal 60. Furthermore, the number of the iron core coils may be a multiple of three, whereby the reactor 6 can be used as a three-phase reactor.

As can be understood from the drawing, the iron core coils 31 to 33 include iron cores 41 to 43 extending in the radial directions of the outer peripheral iron core 20 and coils 51 to 53 wound onto the iron cores 41 to 43, respectively.

The outer peripheral iron core 20 is composed of a plurality of, for example, three, outer peripheral iron core portions 24 to 26 divided in the circumferential direction. The outer peripheral iron core portions 24 to 26 are formed integrally with the iron cores 41 to 43, respectively. The outer peripheral iron core portions 24 to 26 and the iron cores 41 to 43 are formed by stacking a plurality of iron plates, carbon steel plates, or electromagnetic steel sheets, or are formed from dust cores. When the outer peripheral iron core 20 is composed of a plurality of outer peripheral iron core portions 24 to 26, even if the outer peripheral iron core 20 is large, such an outer peripheral iron core 20 can be easily manufactured. Note that the number of the iron cores 41 to 43 and the number of the iron core portions 24 to 26 need not necessarily be the same. Furthermore, through-holes 29*a* to 29*c* are formed in the outer peripheral iron core portions 24 to 26.

The coils 51 to 53 are arranged in coil spaces 51*a* to 53*a* ("coil spaces 51*a* to 54*a*" in the second embodiment, which is described later) formed between the outer peripheral iron core portions 24 to 26 and the iron cores 41 to 43, respectively. In the coil spaces 51*a* to 53*a*, the inner peripheral surfaces and the outer peripheral surfaces of the coils 51 to 53 are adjacent to the inner walls of the coil spaces 51*a* to 53*a*.

Further, the radially inner ends of the iron cores 41 to 43 are each located near the center of the outer peripheral iron core 20. In the drawing, the radially inner ends of the iron cores 41 to 43 converge toward the center of the outer peripheral iron core 20, and the tip angles thereof are approximately 120 degrees. The radially inner ends of the iron cores 41 to 43 are separated from each other via the gaps 101 to 103, which can be magnetically coupled.

In other words, the radially inner end of the iron core 41 is separated from the radially inner ends of the two adjacent iron cores 42 and 43 via gaps 101 and 103. The same is true for the other iron cores 42 and 43. Note that, the sizes of the gaps 101 to 103 are equal to each other.

In the configuration shown in FIG. 1, since a central iron core disposed at the center of the core body 5 is not needed, the core body 5 can be constructed lightly and simply. Further, since the three iron core coils 31 to 33 are surrounded by the outer peripheral iron core 20, the magnetic fields generated by the coils 51 to 53 do not leak to the outside of the outer peripheral core 20. Furthermore, since the gaps 101 to 103 can be provided at any thickness at a low cost, the configuration shown in FIG. 1 is advantageous in terms of design, as compared to conventionally configured reactors.

Further, in the core body 5 of the present disclosure, the difference in the magnetic path lengths is reduced between the phases, as compared to conventionally configured reactors. Thus, in the present disclosure, the imbalance in inductance due to a difference in magnetic path length can be reduced.

Figure 3:
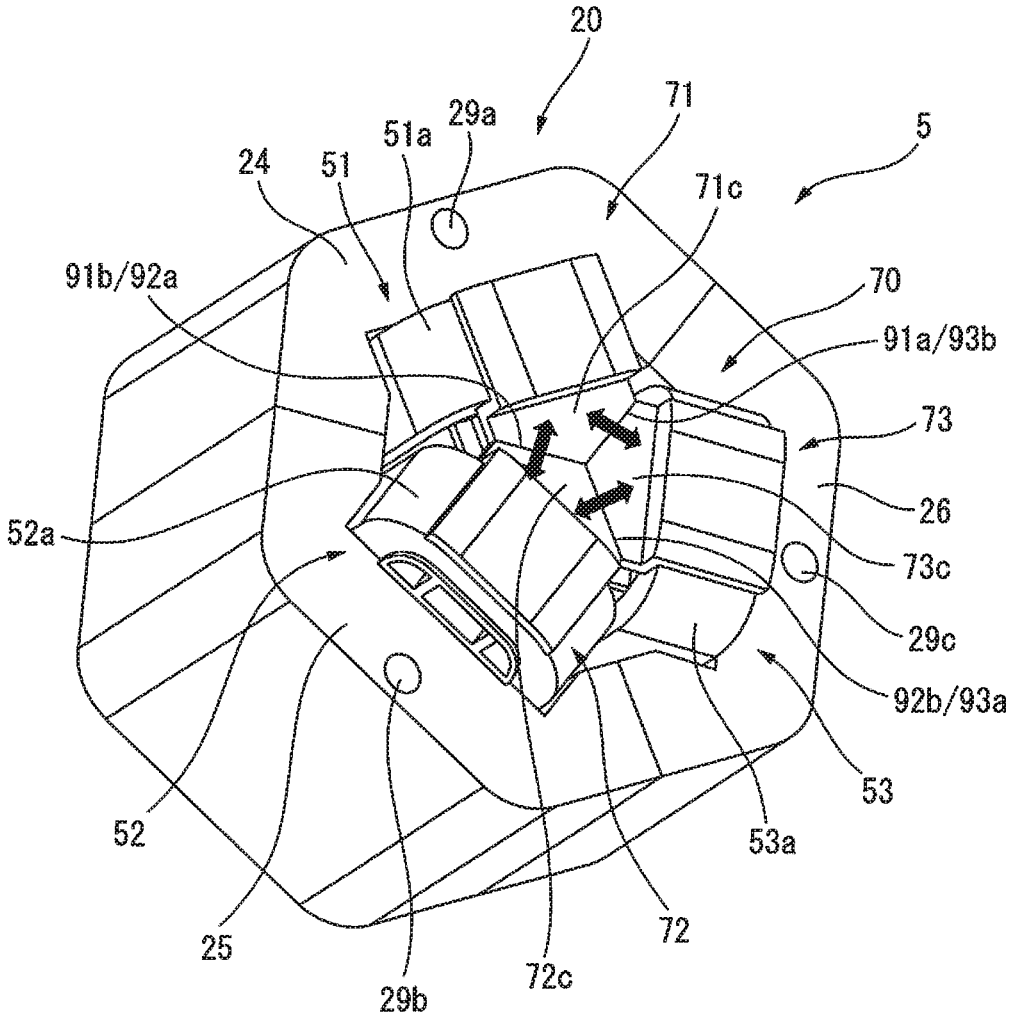
FIG. 3 is a perspective view of the core body of the reactor according to the first embodiment.

FIG. 3 is a perspective view of the core body of the reactor according to the first embodiment. FIG. 3 is a view of the core body 5 as seen from the pedestal 60 side. As shown in the drawing, the protection part 70, which at least partially protects the projection portions 51*a* to 53*a* of the three coils 51 to 53, is arranged on the core body 5. The protection part 70 shown in FIG. 3 covers and protects the furthermost portions of the projection portions 51*a* to 53*a* of the three coils 51 to 53 which are furthest from the core body 5.

The protection part 70 may be a single member, or alternatively, may be composed of a plurality of protection members 71 to 73 for protecting the respective coils 51 to 53. Furthermore, the protection part 70 is preferably formed from a rigid non-magnetic material, such as aluminum, SUS, or a resin. In this case, it is possible to prevent the magnetic field from passing through the protection part 70 when the reactor 6 is energized.

Figure 4A:
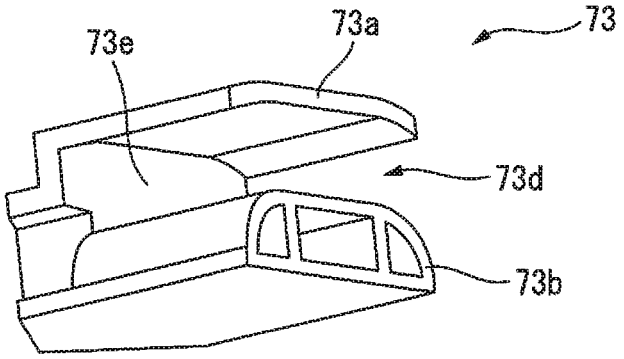
FIG. 4A is a first perspective view of a protection member.
Figure 4B:
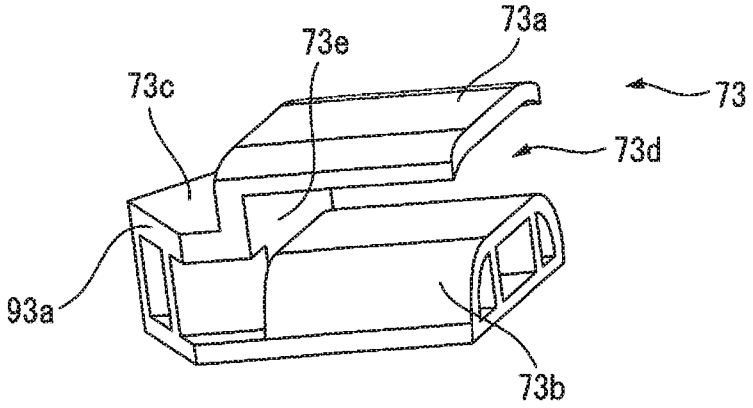
FIG. 4B is a second perspective view of the protection member.
Figure 4C:
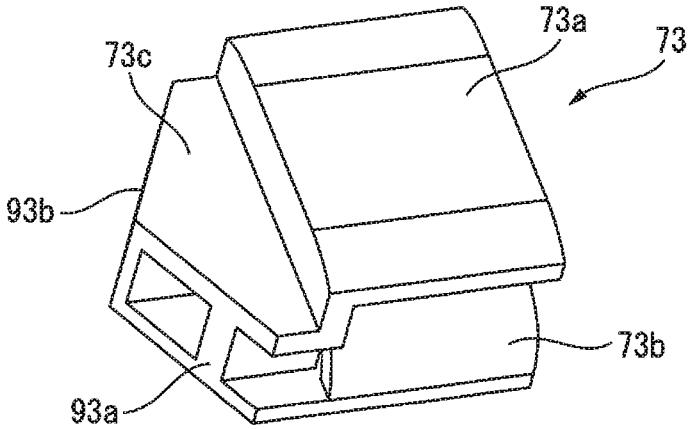
FIG. 4C is a third perspective view of the protection member.

FIG. 4A through FIG. 4C are perspective views of a protection member. FIG. 4A through FIG. 4C show the protection member 73, but the other protection members 71, 72 are configured substantially the same. As shown in these drawings, the protection member 73 includes a cover member 73*a* which at least partially covers the projection portion 53*a* of the coil 53 and an insertion member 73*b* which is inserted between the projection portion 53*a* and the end surface of the core body 5.

The cover member 73*a* and the insertion member 73*b* extend parallel to each other toward the radially outer side of the core body 5. A clearance 73*d* between the cover member 73*a* and the insertion member 73*b* is formed corresponding to one portion of the projection portion 53*a* of the coil 53. The radial inner ends of the cover member 73*a* and the insertion member 73*b* are connected to a connection member 73*e* and supported in a cantilever manner.

The cover member 73*a* preferably covers at least the furthest portion of the projection portion 53*a* of the coil 53. In this case, when the core body 5, to which the protection member 73 and/or the other protection members 71, 72 are attached, is mounted on the floor or the like, damage to the coil 53 and/or the other coils 51, 52 can be prevented. Naturally, the cover member 73*a* may cover the entirety of the projection portion 53*a* of the coil 53.

Further, the protection member 73 includes an abutment member 73*c* which is arranged more radially inward of the core body 5 than the cover member 73*a* and the insertion member 73*b*. The tip of the abutment member 73*c* converges to form a predetermined angle. The value of the predetermined angle is determined by dividing 360° by the number of the iron cores 41 to 43 and is equal to the tip angles of the iron cores 41 to 43, for example, 120°.

The two surfaces constituting the tip of the abutment member 73*c* are the abutment surfaces 93*a* and 93*b*, which are described later.

The other protection members 71, 72 are similarly composed, and include cover members 71*a*, 72*a*, insertion members 71*b*, 72*b*, abutment members 71*c*, 72*c*, clearances 71*d*, 72*d*, and connection members 71*e*, 72*e*, respectively.

Further, the abutment members 71*c*, 72*c* include respective abutment surfaces 91*a*, 91*b*, 92*a*, 92*b*.

Figure 5:
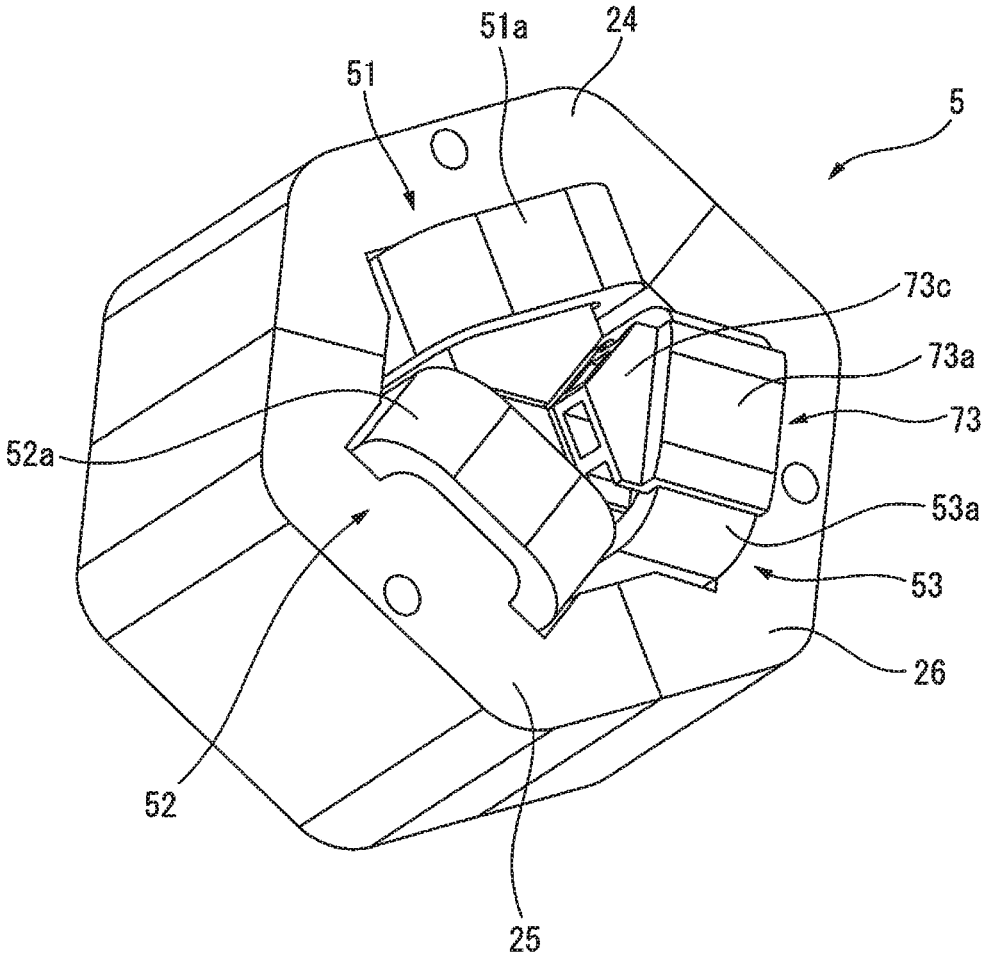
FIG. 5 is another perspective view of a core body.

FIG. 5 is another perspective view of a core body. As shown in FIG. 5, a core body 5 to which coils 51 to 53 are attached is prepared. The insertion member 73*b* of the protection member 73 is inserted between the projection portion 53*a* of the coil 53 and the core body 5, whereby the protection member 73 is attached to the coil 53. Then, the other protection members 71, 72 are likewise sequentially installed onto the coils 51, 52, whereby the protection part 70 as shown in FIG. 3 is arranged on the core body 5.

Figure 6:
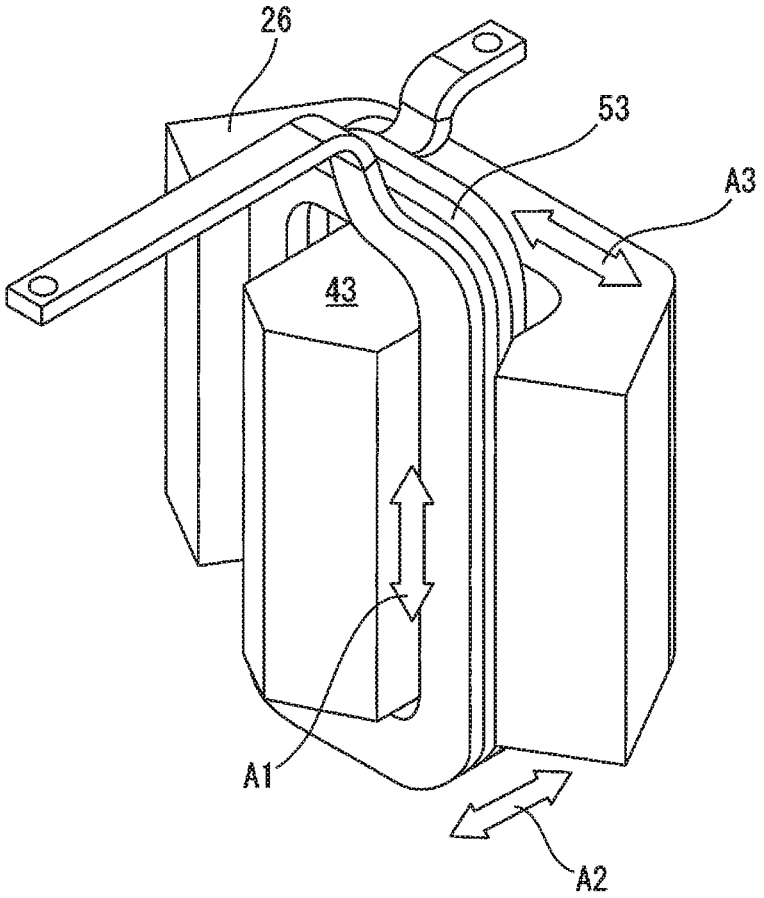
FIG. 6 is a perspective view of an iron core and a coil.

Alternatively, after attaching the coil 53 to the iron core 43, which is integral with the outer peripheral iron core portion 26, the protection member 73 may be attached to the coil 53. The protection members 71, 72 are similarly attached to the iron cores 41, 42 onto which the coils 51, 52 have been attached, and thereafter, the iron cores 41 to 43 may be assembled to form the core body 5. In that case, when the protection members 71 to 73 are attached to the coils 51 to 53, it is possible to prevent the protection members 71 to 73 from interfering with the other protection members, so that installation difficulty can be avoided FIG. 6 is a perspective view of an iron core and a coil. In FIG. 6, the iron core 43, which is integral with the outer peripheral iron core portion 26, is shown as an example, and the coil 53 is attached to the iron core 43. As shown in FIG. 6, the inner circumferential surface of the coil 53 is larger than the inner surface of the iron core 43. Thus, there is axial looseness as indicated by arrow A1, radial looseness as indicated by arrow A2, and circumferential looseness as indicated by arrow A3 between the iron core 43 and the coil 53.

Since the above-mentioned clearance 73*d* of the protection member 73 is formed corresponding to one portion of the projection portion 53*a* of the coil 53, both the surface of the cover member 73*a* adjacent to the coil 53 and the surface of the insertion member 73*b* adjacent to the coil 53*a* are curved surfaces curving from the horizontal plane toward the vertical plane. By retaining the coil 53 between these curved surfaces, movement of the coil 53 in the axial direction (direction A1) and the circumferential direction (direction A3) of the reactor 6 when the reactor 6 is energized can be prevented.

Further, the coil 53 is interposed between the inner surface of the outer peripheral iron core portion 26 and the surface of the connection member 73*e* of the protection member 73. Thus, movement of the coil 53 in the radial direction (direction A2) of the reactor 6 even when the reactor 6 is energized can be prevented.

Further, as can be understood from FIG. 1A, a plurality of shaft parts, for example, screws 99*a* to 99*c*, pass through the through-holes 60*a* to 60*c* of the pedestal 60, the through-holes 29*a* to 29*c* of the core body 5, the through-holes 81*a* to 81*c* of the end plate 81, and the through-holes 65*a* to 65*c* of the terminal block 65. The pedestal 60, core body 5, end plate 81, and terminal block 65 are screw-engaged to each other. The heights of the projecting part 61 of the pedestal 60 and the end plate 81 are preferably greater than the sum of the projecting height of the projection portions 51*a* to 53*a* and the height of the cover members 71*a* to 73*a*. In this case, interference of the protection part 70 with the lower surface of the pedestal 60 or the like can be prevented.

Referring again to FIG. 3, the protection members 71 to 73 are attached to the respective coils 51 to 53 to constitute the protection part 70. The abutment members 71*c* to 73*c* of the protection members 71 to 73 abut each other. Specifically, for example, the two abutment surfaces 93*a*, 93*b* of the abutment member 73*c* abut the abutment surface 92*b* of the abutment member 72*c* and the abutment surface 91*a* of the abutment member 71*c*, respectively. The same is true for the other abutment members 71*c*, 72*c*.

In the first embodiment, the abutment members 71*c* to 73*c* of the protection members 71 to 73 abut each other, whereby the protection members 71 to 73 are pressed radially outwardly. As a result, since the coils 51 to 53 are pressed between the connection members 71*e* to 73*e* of the protection members 71 to 73 and the inner surfaces of the outer peripheral iron core portions 24 to 26, the coils 51 to 53 can be further firmly fastened.

Figure 7:
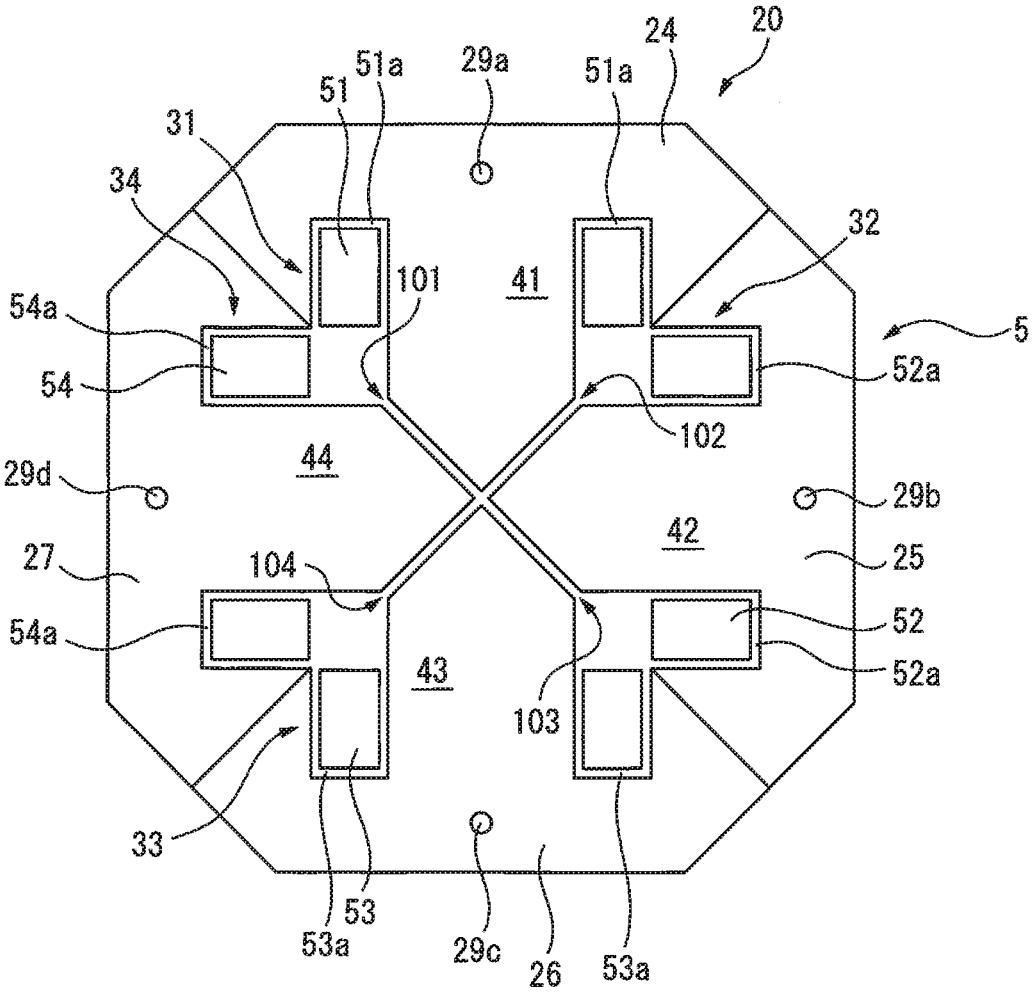
FIG. 7 is a cross-sectional view of the core body of a reactor according to a second embodiment.

FIG. 7 is a cross-sectional view of the core body of a reactor according to a second embodiment. The core body 5 shown in FIG. 7 includes a substantially octagonal outer peripheral iron core 20 and four iron core coils 31 to 34, which are the same as the iron core coils described above, arranged inside the outer peripheral iron core 20. The iron core coils 31 to 34 are arranged at equal intervals in the circumferential direction of the core body 5. Furthermore, the number of the iron cores is preferably an even number not less than four, whereby the reactor including the core body 5 can be used as a single-phase reactor.

As can be understood from the drawing, the outer peripheral iron core 20 is composed of four outer peripheral iron core portions 24 to 27 divided in the circumferential direction. The iron core coils 31 to 34 include iron cores 41 to 44 extending in the radial directions and coils 51 to 54 wound onto the respective iron cores, respectively. The radially outer ends of the iron cores 41 to 44 are integrally formed with the outer peripheral iron core portions 24 to 27, respectively.

Note that the number of iron cores 41 to 44 and the number of iron core portions 24 to 27 need not necessarily be the same. The same is true for the core body 5 shown in FIG. 3.

Further, each of the radially inner ends of the iron cores 41 to 44 is located near the center of the outer peripheral iron core 20. In FIG. 7, the radially inner ends of the iron cores 41 to 44 converge toward the center of the outer peripheral iron core 20, and the tip angles thereof are about 90 degrees. The radially inner ends of the iron cores 41 to 44 are separated from each other via the gaps 101 to 104, which can be magnetically coupled.

Figure 8:
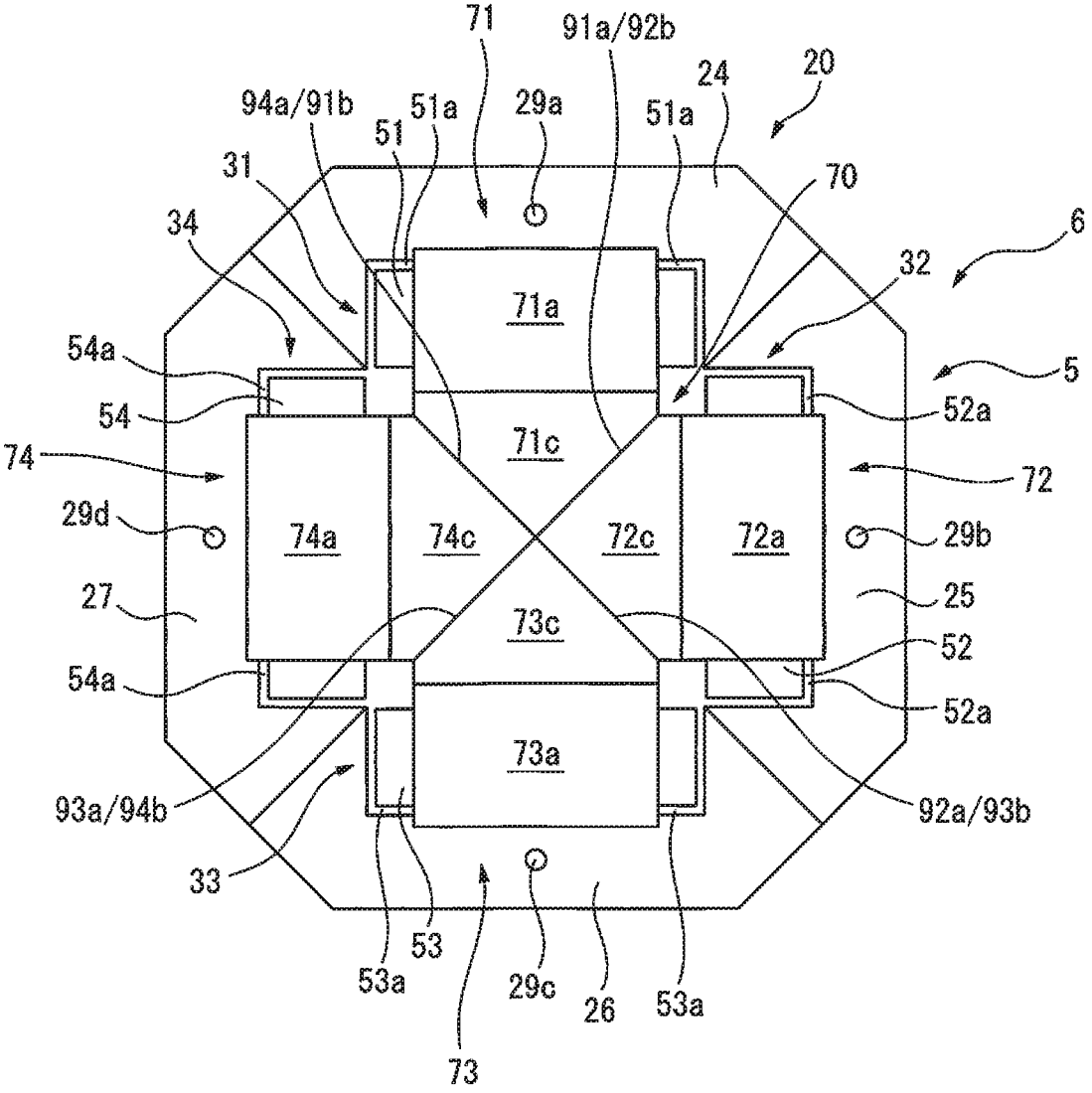
FIG. 8 is an end view of the reactor according to the second embodiment.

Further, FIG. 8 is an end view of the reactor according to the second embodiment. FIG. 8 shows the core body 5 as viewed from the terminal block 65 side. The protection part 70 shown in FIG. 8 is composed of protection members 71 to 74, which are the same as described above. The protection members 71 to 74 of the second embodiment are configured substantially the same as the protection members 71 to 73 of the above-described first embodiment, except for the tip angles of the abutment members 71*c* to 74*c*. In this case, it can be understood that substantially the same effects as described above can be obtained. Furthermore, protection parts 70 may be arranged on the end surface of the core body 5 on the pedestal 60 side and on the end surface on the terminal block 65 side, whereby both ends of the coils in the axial direction of the reactor can be protected.

Aspects of the Disclosure

According to the first aspect, there is provided a reactor (6) comprising a core body (5), the core body comprising an outer peripheral iron core (20), at least three iron cores (41 to 44) arranged in contact with or coupled to an inner surface of the outer peripheral iron core, and at least three coils (51 to 54) wound onto the at least three iron cores, wherein gaps (101 to 104), which can be magnetically coupled, are formed between one of the at least three iron cores and another iron core adjacent thereto, the reactor further comprising a protection part (70) which at least partially protects projection portions (51*a* to 54*a*) of the at least three coils which project from at least one end surface of the core body.

According to the second aspect, in the first aspect, the protection part includes at least three protection members (71 to 74) which protect the respective projection portions of the at least three coils.

According to the third aspect, in the second aspect, the at least three protection members respectively include cover members (71*a* to 74*a*), which at least partially cover the projection portions, and insertion members (71*b* to 74*b*), which are inserted between the projecting portions and the at least one end surface.

According to the fourth aspect, in the second or third aspect, the at least three protection members include abutment members (71*c* to 74*c*) which abut each other at the center of the reactor.

According to the fifth aspect, in any of the first through fourth aspects, the reactor comprises a terminal block (65) and a pedestal (60) which are coupled to the core body so as to interpose the core body therebetween, wherein the protection part is arranged at least one of a region between the terminal block (65) and the core body and a region between the core body and the pedestal.

According to the sixth aspect, in any of the first through fifth aspects, the protection part is formed from a non-magnetic material.

According to the seventh aspect, in any of the first through sixth aspects, the number of the at least three iron cores is a multiple of three.

According to the eighth aspect, in any of the first through sixth aspects, the number of the at least three iron cores is an even number not less than four.

Effects of the Aspects

In the first aspect, since the projection portions of the coils are protected by the protection part, damage to the coils can be prevented.

In the second aspect, the at least three coils can be individually protected.

In the third aspect, since the projection portions of the coils are interposed by cover members and insertion members, vibration of the coils in the axial direction of the reactor when the reactor is energized can be prevented.

In the fourth aspect, since the abutment members of the projection members abut each other, vibration of the coils in the radial direction of the reactor when the reactor is energized can be prevented.

In the fifth aspect, when projection parts are arranged both between the terminal block and the core body and between the core body and the pedestal, both ends of the coils in the axial directions of the reactor can be protected.

In the sixth aspect, the magnetic field can be prevented from passing through the protection part.

In the seventh aspect, the reactor can be used as a three-phase reactor.

In the eighth aspect, the reactor can be used as a single-phase reactor.

Though the present invention has been described using representative embodiments, a person skilled in the art would understand that the foregoing modifications and various other modifications, omissions, and additions can be made without departing from the scope of the present invention.

The invention claimed is:

1. A reactor comprising a core body, the core body comprising:

an outer peripheral iron core, at least three iron cores arranged in contact with or coupled to an inner surface of the outer peripheral iron core, and at least three coils wound onto the at least three iron cores, wherein gaps, which can be magnetically coupled, are formed between one of the at least three iron cores and another iron core adjacent thereto, the at least three coils comprise projection portions which project from both end surfaces of the core body, the reactor further comprises:

a protection part which at least partially protects each of the projection portions for all of the projection portions on at least one end surface of the core body, and the protection part comprises at least three protection members which protect the respective projection portions on at least one end surface of the core body.

2. The reactor according to claim 1, comprising a terminal block and a pedestal which are coupled to the core body so as to interpose the core body therebetween, wherein the protection part is arranged in at least one of between the terminal block and the core body and between the core body and the pedestal.

3. The reactor according to claim 1, wherein the protection part is formed from a non-magnetic material.

4. The reactor according to claim 1, wherein the number of the at least three iron cores is a multiple of three.

5. The reactor according to claim 1, wherein the number of the at least three iron cores is an even number not less than four.

6. The reactor according to claim 1, wherein gaps between the cover members and the insertion members have shapes corresponding to a portion of the projection portions.

7. The reactor according to claim 1, wherein the at least three protection members respectively include cover members, which at least partially cover the projection portions, and insertion members, which are inserted between the projecting portions and the at least one end surface.

8. The reactor according to claim 1, wherein the at least three protection members respectively include abutment members which abut each other at the center of the reactor.

* * * * *